United States Patent [19]

Stauss et al.

[11] Patent Number: 4,644,728

[45] Date of Patent: Feb. 24, 1987

[54] SECURING ELEMENTS FOR ATTACHING ON OR TO CONSTRUCTION SERVING ADDITIONS TO STRUCTURES

[75] Inventors: Eberhard Stauss, Munich; Hans-Rudolf Klein, Berg; Alfons Thalmeir, Munich, all of Fed. Rep. of Germany

[73] Assignee: Dyckerhoff & Widmann AG, München-Riem, Fed. Rep. of Germany

[21] Appl. No.: 691,160

[22] Filed: Jan. 14, 1985

[30] Foreign Application Priority Data

Jan. 17, 1984 [DE] Fed. Rep. of Germany ... 8401113[U]
Jul. 16, 1984 [DE] Fed. Rep. of Germany ..... 3426118

[51] Int. Cl.[4] ..... E04D 13/15; E04B 1/56

[52] U.S. Cl. ..... 52/710; 52/73; 52/94; 52/182; 49/404; 49/407; 248/248; 248/300

[58] Field of Search ..... 52/71, 90, 94, 73–78, 52/710, 79.9, 182; 49/404, 407, 413, 426; 248/48.2, 300, 248

[56] References Cited

U.S. PATENT DOCUMENTS

| | | | |
|---|---|---|---|
| 1,073,563 | 9/1913 | Bemis | 49/426 |
| 2,730,778 | 1/1956 | Pax | 52/76 |
| 2,762,089 | 9/1956 | Auble | 52/78 |
| 3,107,401 | 10/1963 | Heirich | 52/94 |
| 3,113,434 | 12/1963 | Phillips | 52/90 |
| 3,507,078 | 4/1970 | Sayers | 52/95 |
| 3,545,144 | 12/1970 | Sickler | 248/48.2 |
| 3,550,381 | 12/1970 | South | 248/48.2 |
| 3,612,453 | 10/1971 | Zimmer | 248/48.2 |
| 3,735,540 | 5/1973 | Thaler | 52/94 |
| 3,766,694 | 10/1973 | Minialoff | 52/95 |
| 3,783,564 | 1/1974 | Dunn | 52/94 |
| 3,932,968 | 1/1976 | Heirich | 52/90 |
| 4,195,452 | 4/1980 | Smith | 52/94 |
| 4,286,716 | 9/1981 | Budich | 49/404 |
| 4,411,109 | 10/1983 | Struben | 52/75 |

FOREIGN PATENT DOCUMENTS

| | | | |
|---|---|---|---|
| 2233727 | 1/1974 | Fed. Rep. of Germany | 52/94 |

*Primary Examiner*—John E. Murtagh
*Attorney, Agent, or Firm*—Max Fogiel

[57] ABSTRACT

The securing element (16) for tensionally fastening additions like roof balustrades (14), exterior stairways (15), roofs (11), arbors, greenhouses (13), pergolas (12), advertising elements, poster walls, etc. that function as extensions or expansions, to structures, especially single-story structures erected with with a kit of components. The securing element (16) extends over the total length of one side of the main structure (10) and has at least one fastening rail (22 or 23) that extends over its own total length.

1 Claim, 7 Drawing Figures

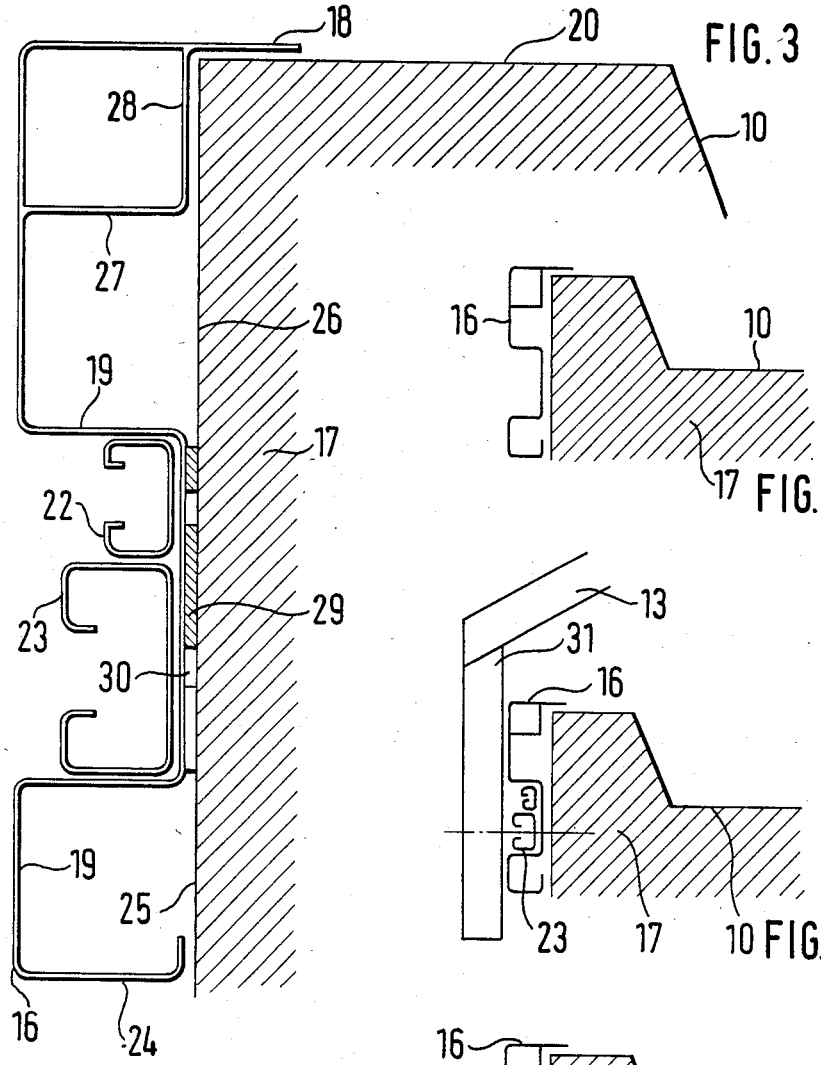
FIG. 3
FIG. 4
FIG. 5
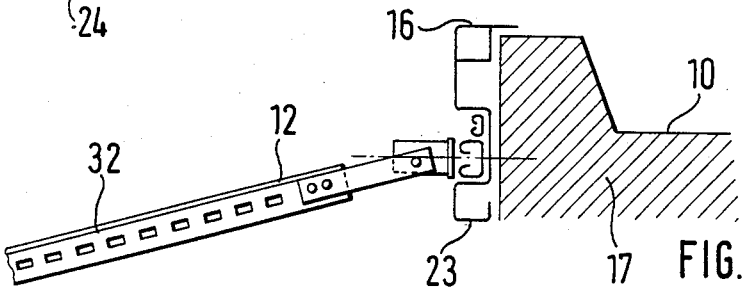
FIG. 6

SECURING ELEMENTS FOR ATTACHING ON OR TO CONSTRUCTION SERVING ADDITIONS TO STRUCTURES

The invention concerns a securing element for tensionally fastening additions that function as extensions or expansions, to structures, such as single-story structures erected with a kit of components.

Extensions or expansions such as lean-tos, arbors, interior shelving, sheds, etc. are frequently added on to garages or other structures, and single-story structures. With all of these measures, holes have to be bored in the main structure and the components tensionally fastened to it with screws and dowels, which is not only expensive but allows only slight alterations, and those with practically no less labor than was devoted to erecting the original structure.

The object of the invention is to provide a securing element for tensionally fastening additions that is simple and will not require as much labor.

The securing element can be used to ensure simple and reliable attachment of extensions like greenhouses, pergolas, roof elements, roof balustrades, exterior stairways, arbors, etc. The securing element can also be applied later as a separate component to existing structures like garages, preferably continuously around the upper edge of each side of the structure. In the form of cornices constructed from an angular structural section of metal or plastic, the elements seal off the upper and outer edge of the structure and constitute in conjunction with a depression in the form of horizontal groove an esthetically pleasing jointed upper seal for the main structure. It covers up the fastening rail inserted into the depression and protects it from the weather. Either a gabled roof covering the main structure or trellises, pergolas, greenhouse frames, etc. can then be fastened to the rails. If the securing element is employed inside a structure, absolutely stable shelves, workbenches, illumination elements, suspended floors, and similar built-ins or built-ons can be applied to it.

Practical embodiments and developments of the invention are characterized in the subsidiary claims.

Figure 1:
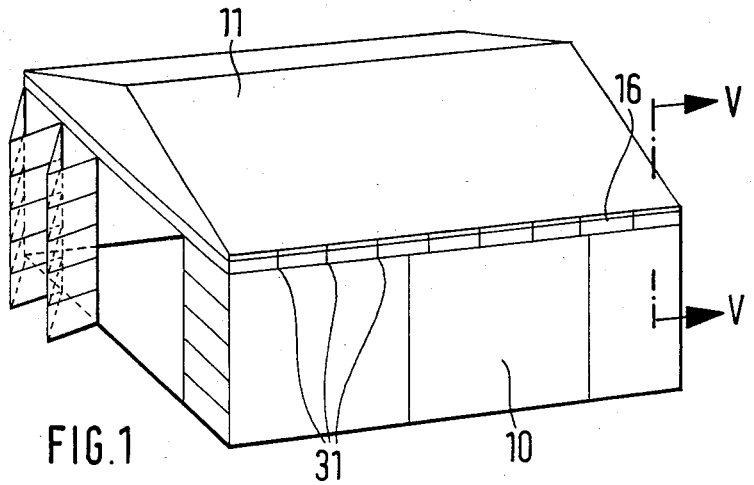

A preferred embodiment of the invention will now be described with reference to the drawing, in which FIG. 1 illustrates a single-story structure with a gabled roof added to it and FIG. 2 a single-story structure with a pergola and the framework of a greenhouse added to it, FIG. 3 is a schematic section through a securing element, FIG. 4 a larger-scale schematic section through the element illustrated in FIG. 3, FIG. 5 is a section along line V—V in FIG. 1, FIG. 6 is a section along line IV—IV in FIG. 2, and FIG. 7 a perspective view of a structure with a balustrade around its roof and with an exterior stairway.

Figure 2:
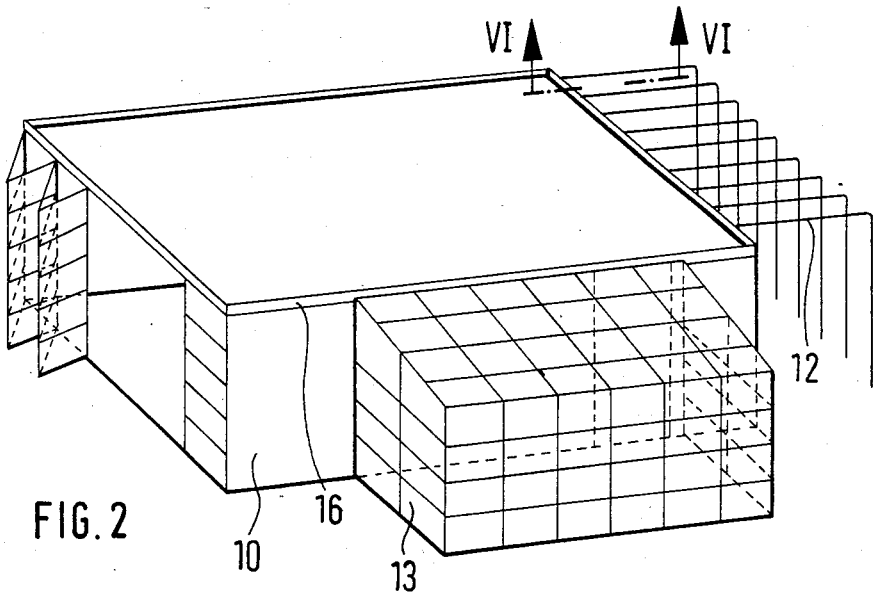
Figure 7:
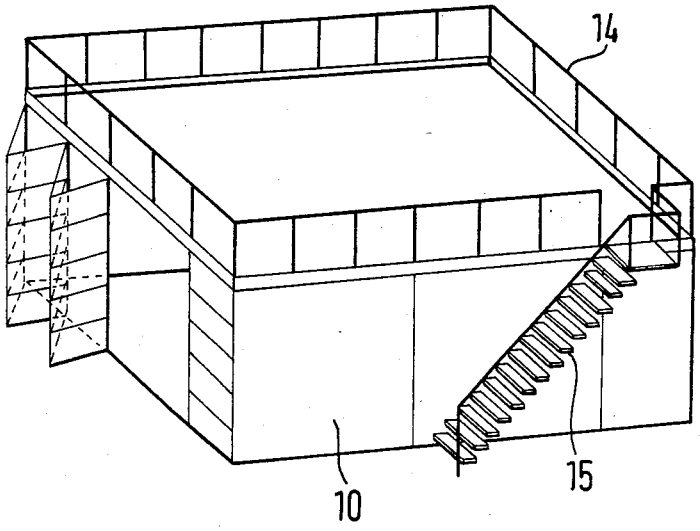

The main structure, labeled 10 overall, illustrated in FIGS. 1, 2, and 7 has a gabled roof 11 (FIG. 1), a pergola 12 and a framework for a greenhouse 13 (FIG. 2), and a balustrade 14 around its roof and exterior stairway 15 (FIG. 7). These additions have been applied to the upper part of the outside 17 of main structure 10 with securing element 16 illustrated in section in FIG. 3.

The securing element has an angled cross-section with an upper flank 18 and with a lower flank 19 that merges into it at a right angle. Upper flank 18 is applied to the top 20 of the upper part of the outside 17 of main structure 10. Lower flank 19 has a depressed area 21 that two, in themselves known, Halfen rails 22 and 23 with different-size cross-section can be inserted into. Lower flank 19 has two right-angled bends 24 and 25 extending parallel toward main structure 10. Bend 25 functions as a seat for the outside 26 of main structure 10. Between upper flank 18 and lower flank 19 there is also an angle 27, attached by welding for example, with an angle flank 28 that also abuts against the outside 26 of main structure 10.

A mounting plate 29 with bores 30 through it can also be positioned against the back of depressed area 21, can be attached by welding for example to securing element 16, and functions in the illustrated embodiment as a cornicing element.

FIG. 4 is a schematic section through securing element 16 with no fastening rails 22 and 23 inserted. In this embodiment, securing element 16 can function as an esthetic upper seal for main structure 10.

FIG. 5 illustrates how a gabled roof 11, which has vertical beams 31, can be fastened to the securing element 16 itself.

FIG. 6 illustrates the beam 32 of a pergola 12, which can also be fastened to a fastening rail 23 with fasteners that are in themselves known.

What is claimed is:

1. A securing arrangement for tensionally fastening an additive structure to a main building structure, comprising: a main building structure with one side to which an additive structure is to be secured; a securing element mounted on said main structure and extending over substantially the total length of said side of said main building structure; at least one fastening rail held by said securing element and extending over substantially the total length of said securing element; said securing element has an upper flank section and a lower flank section connected together by a base section forming a depressed area with sides of said upper flank section and said lower flank section, said fastening rail being held in said depressed area; said upper flank section and said lower flank section comprising each two arms joined by a connecting section positioned substantially parallel to an outside surface of said main building structure, said arms extending towards said outside surface of said main building structure, said lower flank section and said upper flank section having each an arm forming said sides connected to said base section, each said connecting section joining said arms being spaced from said outside surface of said main building structure; and an angle section having one arm joined to the connecting section of said upper flank section, said angle section having another side joined to the arm of said upper flank section positioned opposite the arm of said upper flank section which is connected to said base section, said angle section forming a rectangular cross section with the connecting section and the arm of the upper flank section to which said angular section is joined; said arms of said upper flank section and said lower flank section being parallel to each other; two fastening rails being positioned in said depressed area; said fastening rails having different-size cross sections; said angle section forming an abutment for said outside surface of said main building structure; said angle section comprising a continuous angled rail; a mounting plate positioned between said depressed area and said outside surface of said main building structure for mounting said securing element thereto.

* * * * *